US005894104A

United States Patent [19]

Hedberg

[11] Patent Number: 5,894,104

[45] Date of Patent: Apr. 13, 1999

[54] COAX-SLICKLINE CABLE FOR USE IN WELL LOGGING

[75] Inventor: Harold Hedberg, Sugar Land, Tex.

[73] Assignee: Schlumberger Technology Corporation, Houston, Tex.

[21] Appl. No.: 08/856,767

[22] Filed: May 15, 1997

[51] Int. Cl.[6] ..... H01B 7/34

[52] U.S. Cl. ..... 174/36; 174/75 B

[58] Field of Search ..... 174/20, 28, 36, 174/102 R, 111, 74 A, 75 B; 385/100, 101, 107, 108, 109, 112, 113

[56] References Cited

U.S. PATENT DOCUMENTS

| | | | |
|---|---|---|---|
| 1,750,111 | 3/1930 | Mahlke | 174/28 |
| 2,936,357 | 5/1960 | Crawford . | |
| 3,436,287 | 4/1969 | Windeler . | |
| 3,800,066 | 3/1974 | Whitfill, Jr. et al. . | |
| 4,000,416 | 12/1976 | Goell . | |
| 4,288,144 | 9/1981 | Nakai et al. | 385/100 |
| 4,660,928 | 4/1987 | Jaeger et al. . | |
| 4,717,608 | 1/1988 | Meltsch | 174/74 A X |
| 5,150,443 | 9/1992 | Wijnberg . | |
| 5,202,944 | 4/1993 | Riordan | 385/101 |
| 5,275,038 | 1/1994 | Sizer et al. | 385/100 X |
| 5,642,780 | 7/1997 | Moore | 166/65.1 |

FOREIGN PATENT DOCUMENTS

WO 95/04290 2/1995 WIPO .

OTHER PUBLICATIONS

BIW Cable Systems, Inc. Specification Sheet for Part No. 022104, 1989.

*Primary Examiner*—Bot L. Ledynh
*Assistant Examiner*—Chau N. Nguyen
*Attorney, Agent, or Firm*—John J. Ryberg; Brigitte L. Jeffery

[57] ABSTRACT

A slick-line coax cable for use in downhole well-logging under conditions which would normally prevent logging with standard 'stranded' line cables includes a device for preventing migration of fluid inside the cable, a coaxial conductive layer of metal to allow more efficient data transfer from the downhole logging tools to the surface recording equipment, and a seal for terminating the downhole end of the metal-encapsulated cable thereby preventing downhole pressure and fluid migration into the cable.

2 Claims, 2 Drawing Sheets

COAX-SLICKLINE CABLE FOR USE IN WELL LOGGING

FIELD OF THE INVENTION

This invention relates generally to a coax cable for use in logging an earth formation traversed by a borehole, and more particularly, a slick-line coax cable for use in downhole well-logging.

BACKGROUND OF THE INVENTION

Gathering petrophysical, geophysical and well production information through well logging techniques using instruments suspended with stranded cables is well known and widely practiced. Typical measurements made by such methods include various types of geophysical and petrophysical measurements as well as various types of well production information including, but not limited to, formation pressure, flow rate, cement status, water flow, corrosion and the response of the well bore environment to sundry electrical, acoustic, nuclear and magnetic stimuli.

The conventional cable used in well-logging is a stranded multi-conductor cable which includes a layer of armor strands. One version of this cable has a core comprised of six outer conductors cabled around a single center conductor and embedded in a neoprene matrix. The outer conductors are formed by copper wire strands twisted around a single center strand. Each conductor is covered with a layer of suitable insulation material. Although the neoprene matrix fills substantially all the voids between conductors within the cable core, voids still may exist within the conductors themselves between and about the strands. The core is surrounded by a jacket of insulating material. The jacket is enclosed by a first and a second layer of armor strands. The core may include electrical conductors and/or optical fibers and electrical insulating and mechanical protecting sheaths immediately surrounding the electrical conductors or the optical fibers. In a second version of this cable, the jacket between the core and the armor strands is made of a thermoplastic material such as Polyethylene or Ethylene Propylene Copolymer (EPC). This thermoplastic material is such that it allows strands to embed into the jacket material. The armor strands lie in grooves generated on the periphery of the jacket and the grooves help to maintain the armor strands in a close relationship with the jacket/core. When tension is applied to the cable, the thermoplastic material fills the interstices between the armor strands, the armor strands embed deeper into the jacket material, and over time, the cable becomes permanently elongated.

Although use of the foregoing cables is highly satisfactory for many well logging operations, use of either cable in a well containing substantial amounts of low molecular weight hydrocarbons, such as methane gas, involves a substantial risk of failure in the cable and/or the cable terminations when the cable is rewound after a logging job. Due to the borehole depth and a wellbore temperature in excess of 150° C., which is quite common, the gas can permeate the matrix of the cable and the insulation materials of the conductors due to a phenomenon that may be called activated diffusion. The permeation causes pressure buildup and gas entrapment in the conductor voids. As the cable is removed from the well and wound back upon the drum at the surface, release of the entrapped gas is only accomplished through bleed out at the terminated ends of the conductors, or outright rupture of the insulation materials themselves. In either case, releasing the gas may result in an undesirable cable failure due to an electrical short.

Other characteristics in a borehole environment, in particular downhole pressure, can greatly affect cable performance. Extremely high pressure can cause the migration of borehole fluid inside the cable. This migration of fluid will directly affect the transfer of data from the downhole logging tool to the surface. In addition, downhole pressure can enter the cable and damage the conductor insulation.

For the foregoing reasons, there is a need for an apparatus which isolates pressure from the surface environment while simultaneously permitting the entrance and movement of a cable for downhole logging.

SUMMARY OF THE INVENTION

A single strand copper conductor is insulated with a layer of extruded high temperature polymer and then encapsulated inside a longitudinally welded, cold worked metal tube. The tube is manufactured from a material selected for its mechanical property and corrosion resistance. Possible materials include carbon steel, type 304 stainless steel, type 316 or 316L stainless steel, or a high nickel alloy such as Incoloy 825. The insulated conductor is placed inside the tube as the tube is being formed and welded.

Because of the poor electrical characteristics of available metal tubing having the desired mechanical characteristics, a conductive copper layer is placed between the polymer insulation and the metal tube. The copper conductive layer may be comprised of a longitudinally 'cigarette wrapped' tape, a helically wrapped tape either with or without a thin plastic (e.g. mylar) backing, a helically 'served' copper shield composed of individual very small copper conductors, or a braided copper shield composed of individual very small copper conductors.

To prevent pressure and fluid migration within the void space between the encapsulating metal tube and the conductive core, a method for creating isolated blocking dams or a continuous pressure block is provided. The dams may be either tape, oil, grease or a high temperature elastomer either with or without curatives. The dams are constructed during the tube fabrication without interruption of the tubing operation. Alternatively, the blocking tape, oil, grease or elastomer may be applied in a thin continuous process.

Alternative to applying the pressure dams/layer during tubing construction, a method whereby the blocking substance may be injected into the void space is provided. The injected substance may be a viscous oil (e.g. silicon), a flowable grease (e.g. butyl rubber), or a fluid elastomer (e.g. neoprene) either with or without curatives.

In order to prevent pressure or fluid entrance into the downhole end, a rubber boot is provided. The boot is manufactured from a high temperature rated fluoroelastomer such as PTFE or another suitable elastomer. The boot has two bore diameters, one to match the outside diameter of the encapsulating metal tube and the other to match the diameter of the polymer insulation around the central copper conductor. To prevent extrusion of the rubber boot into the void space between the cable core and the encapsulating metal tube and the consequent destruction of the central copper conductor's insulation layer, a plastic insert (e.g. PEEK or another plastic not susceptible to plastic deformation at high temperatures and pressures) is provided.

To prevent yielding and uncontrolled stretching of the tube as it is coiled and uncoiled from the surface equipment, the invention includes a sheave system designed to minimize the tube strain.

BRIEF DESCRIPTION OF THE DRAWINGS

The advantages of the present invention will become apparent from the following description of the accompanying drawings. It is to be understood that the drawings are to be used for the purpose of illustration only, and not as a definition of the invention.

In the drawings.

DETAILED DESCRIPTION OF THE INVENTION

Figure 1:
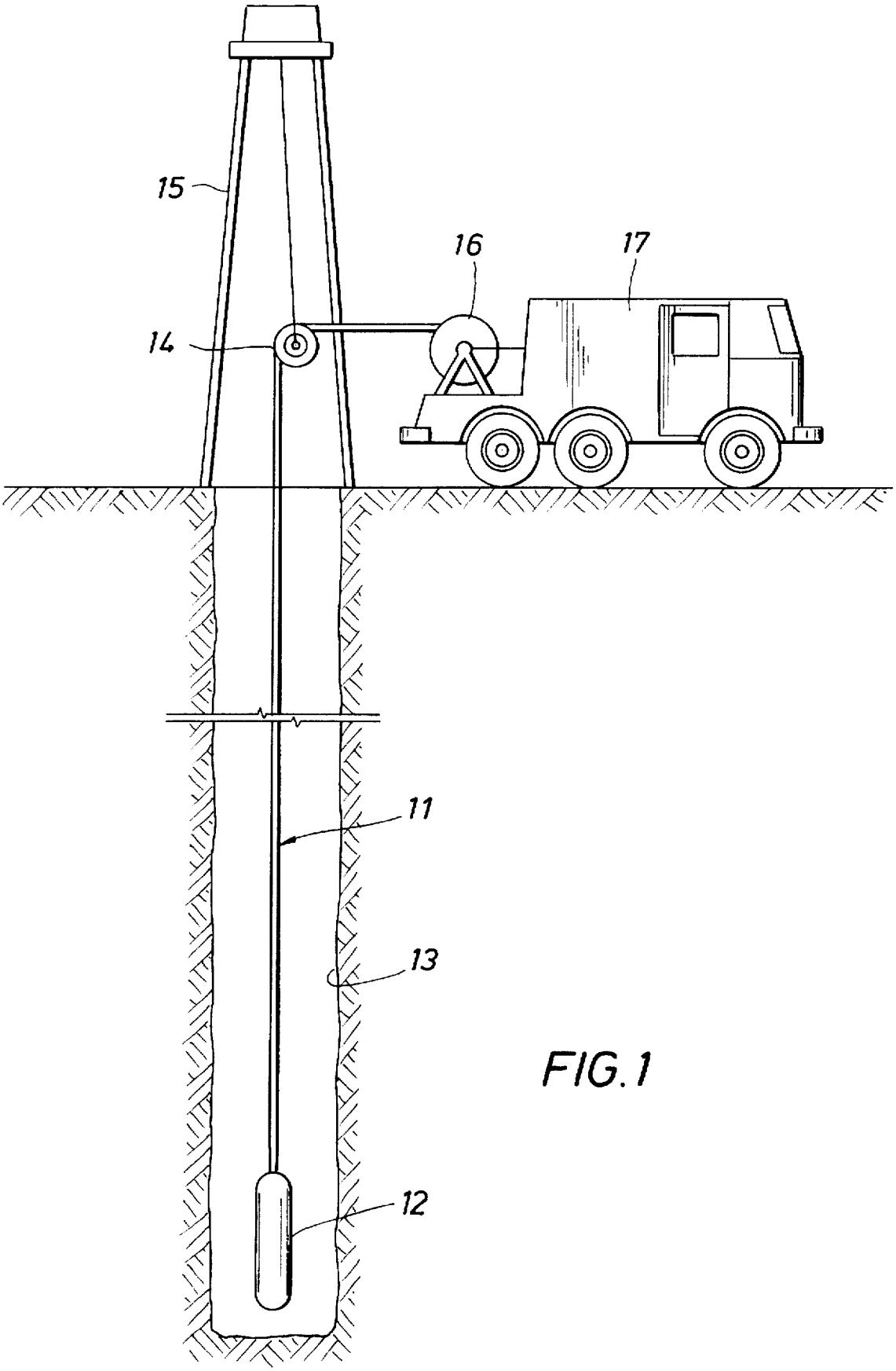
FIG. 1 illustrates a cable constructed according to present invention lowered into a borehole drilled into the earth.

The implementation of the slick line cable according to the present invention is illustrated in FIG. 1. A cable 11 is shown supporting a well logging sonde 12, for example, in a borehole 13 drilled into the earth. The cable 11 passes over a pulley 14 attached to a structure 15 erected on the earth surface. The upper end of the cable is secured to a conventional winch 16 by a means which will enable the sonde 12 be lowered into and withdrawn from the well 13. The winch 16 may be mounted on a truck 17 incorporating the usual electronic devices for the transmission, processing, display or other like processing steps of the data issued from the sonde 12, as well as for the control of the operation of the sonde 12.

Figure 2:
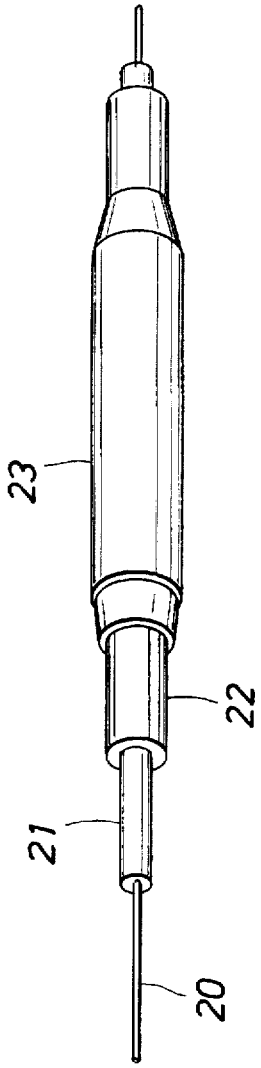
FIG. 2 is a view of the slick line cable in the present invention.

The cable of the present invention is shown in FIG. 2. This cable comprises a slick line conductor 20 for transmitting data. Conductor 20 is comprised of a single, solid wire having an approximate diameter between 0.067" and 1.1875". In a preferred embodiment, conductor 20 is comprised of a solid copper wire. A layer of extruded high temperature polymer insulation material 21, such as PFA, PFE, FEP, ETFE, TEFZEL™, TEFLON™, or a similar material, coaxially surrounds the conductor 20. This material 21 serves to insulate the conductor 20 from the conductive copper layer 22 and metal tube 23. A layer of stranded copper wire 22 surrounds the insulation layer 21. This layer 22 serves to enhance telemetry characteristics. The copper conductor 20, insulating polymer 21 and the stranded copper wire 22 are all encapsulated inside a longitudinally welded, cold worked metal tube 23. The tube is manufactured from a material chosen for its mechanical property and corrosion resistance. Possible materials include carbon steel, type 304 stainless steel, type 316 or 316L stainless steel or a high nickel alloy such as Incoloy 825. The insulated conductor 20, 21 is placed inside the steel tube 23 as the tube is being formed and welded.

Figure 3:
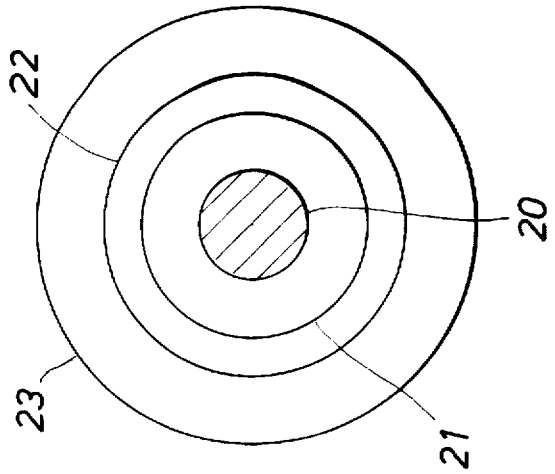
FIG. 3 is a front cross-section view of the slick line cable of the present invention; and, FIG. 4 is a side cross-section view of the slick line cable of the present invention showing the fluid/pressure blockers.
Figure 4:
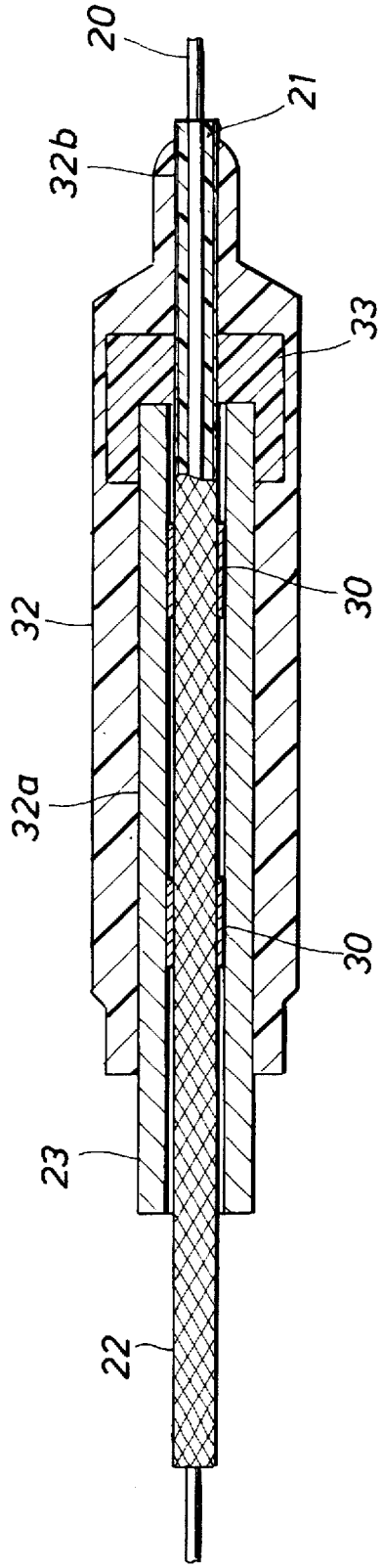

FIG. 3 shows a cross-sectional view of the cable as encapsulated in the tube 23. However, not shown between the copper strands layer 22 and the steel tube 23 are void spaces due to component geometries. The existence of these voids increases the possibility of pressure and fluid migration into and within these spaces during cable operations. As shown in FIG. 4, to prevent these pressure and fluid migrations, isolated blocking dams 30 or continuous pressure blocks are provided inside the cable. The dams may be either tape, oil, grease or a high temperature elastomer either with or without curatives. The blocking dams 30 are constructed during the steel tube fabrication without interruption of the tubing operation. Alternatively, the blocking tape, oil, grease glue or elastomer may be applied in a thin continuous process.

As an alternative to applying the pressure dams 30 during tubing construction, a blocking substance is injected into the void space. The injected blocking substance can be a viscous oil such as silicon, a flowable grease such as butyl rubber or a fluid elastomer such as neoprene either with or without curatives.

In order to prevent pressure or fluid entrance into the downhole end of the cable, a rubber boot 32 is provided to serve as a seal for that end of the cable. The boot 32 is manufactured from high temperature rated fluoro-elastomer, either PTFE or other suitable elastomer. The boot has two diameters **32*a* and 32*b*. One diameter matches the diameter of the encapsulating metal tube 23 and the other diameter matches the diameter of the polymer insulation 21 around the central copper conductor 20. To prevent the extrusion of the rubber boot 32 into the void space between the cable core and encapsulating metal tube, which would lead to the destruction of the insulation layer 21, a plastic insert 33 is provided. This insert 33** can be of PEEK or other plastic not susceptible to deformation at high temperatures and pressures.

The present invention is constructed by forming a continuous flat strip of metal into a tubular member 23 with edges of the metal strip being juxtaposed. The edges of the strip are then welded together to provide a fluid-tight tubular member. Furthermore, the electrical conductor 20 is fed into the tube 23 simultaneously with the forming and welding of the tubular member.

The foregoing description of the preferred and alternate embodiments of the present invention have been presented for purposes of illustration and description. It is not intended to be exhaustive or limit the invention to the precise form disclosed. Obviously, many modifications and variations will be apparent to those skilled in the art. The embodiments were chosen and described in order to best explain the principles of the invention and its practical application thereby enabling others skilled in the art to understand the invention for various embodiments and with various modifications as are suited to the particular use contemplated. It is intended that the scope of the invention be defined by the accompanying claims and their equivalents.

We claim:

1. A slick-line coax cable for use in logging an earth formation traversed by a borehole, comprising:

a) a conductor for carrying a signal;

b) an insulating means coaxially surrounding said conductor;

c) a shielding means surrounding said insulating means and said conductor, said shielding means having the ability to enhance a characteristic of said conductor;

d) a tubular shaped member encompassing said shielding means, said insulating means, and said conductor to form an exterior cover for said cable; and e) a sealing means surrounding one end of said cable, said sealing means being adapted to prevent pressure and fluid migration into said one end of said cable; wherein said sealing means has a first inner diameter substantially equal to the diameter of said tubular member and a second inner diameter substantially equal to the diameter of said insulating means.

2. The slick line cable of claim 1 wherein said sealing means is comprised of a high temperature rated elastomer.

* * * * *